US009812805B2

(12) United States Patent
Tomine et al.

(10) Patent No.: US 9,812,805 B2
(45) Date of Patent: Nov. 7, 2017

(54) ABUTTING TYPE CONNECTOR

(71) Applicant: YAZAKI CORPORATION, Tokyo (JP)

(72) Inventors: Kazuhiro Tomine, Shizuoka (JP); Yasuhiro Otsuta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/896,524

(22) PCT Filed: Jul. 3, 2014

(86) PCT No.: PCT/JP2014/067818

§ 371 (c)(1),
(2) Date: Dec. 7, 2015

(87) PCT Pub. No.: WO2015/002274

PCT Pub. Date: Jan. 8, 2015

(65) Prior Publication Data

US 2016/0149328 A1 May 26, 2016

(30) Foreign Application Priority Data

Jul. 3, 2013 (JP) ..... 2013-140033

(51) Int. Cl.
*H01R 13/11* (2006.01)
*H01R 13/24* (2006.01)
*H01R 13/04* (2006.01)

(52) U.S. Cl.
CPC ..... *H01R 13/2457* (2013.01); *H01R 13/04* (2013.01); *H01R 13/11* (2013.01); *H01R 13/2464* (2013.01)

(58) Field of Classification Search
CPC .... H01R 13/04; H01R 13/11; H01R 13/2457; H01R 13/2464
(Continued)

(56) References Cited

U.S. PATENT DOCUMENTS 4,056,299 A * 11/1977 Paige ..... H01R 4/4818 439/225
4,460,231 A * 7/1984 Muz ..... H01R 13/20 439/491
(Continued)

FOREIGN PATENT DOCUMENTS

JP 58-61655 U 4/1983
JP 5-66884 U 9/1993
(Continued)

OTHER PUBLICATIONS

International Search Report and Written Opinion of the International Search Report for PCT/JP2014/067818 dated Aug. 5, 2014.
(Continued)

*Primary Examiner* — Renee S Luebke
*Assistant Examiner* — Paul Baillargeon
(74) *Attorney, Agent, or Firm* — Kenealy Vaidya LLP

(57) ABSTRACT

A butting surface (21) of a first butting terminal fitting (20) held by a first terminal accommodating member (40) is formed in a curved-surface configuration protruding toward a second butting terminal fitting (30) side held by a second terminal accommodating member (50). A plurality of contact spring pieces (33*a* and 33*b*) of the second butting terminal fitting (30) which are butted against the butting surface (21) and resiliently deformed are flat plate type leaf springs arranged on the same plane.

9 Claims, 7 Drawing Sheets

(58) Field of Classification Search
USPC ..... 439/851, 289, 862, 436, 437, 438, 439, 439/440, 441
See application file for complete search history.

(56) References Cited

U.S. PATENT DOCUMENTS 5,199,879 A * 4/1993 Kohn ..... H01R 24/58 439/63
5,326,412 A * 7/1994 Schreiber ..... B32B 37/12 156/150
5,775,963 A * 7/1998 Byfield, Jr. ..... H01R 13/04 439/884
5,812,378 A * 9/1998 Fjelstad ..... G01R 1/0466 257/E23.067
6,249,135 B1 6/2001 Maruyama et al.
6,664,131 B2 * 12/2003 Jackson ..... H01L 23/49811 257/E23.065
6,676,455 B2 * 1/2004 Machado ..... H01R 11/282 439/855
6,995,577 B2 * 2/2006 Farnworth ..... G01R 1/0466 324/756.05
7,044,755 B2 * 5/2006 Hatakeyama ..... H01R 4/64 439/927
2001/0011724 A1 8/2001 Maruyama et al.
2004/0110399 A1 6/2004 Soeta
2004/0124866 A1 7/2004 Maruyama et al.
2005/0162180 A1 7/2005 Maruyama et al.
2006/0028222 A1 * 2/2006 Farnworth ..... G01R 1/0466 324/754.08
2015/0093945 A1 4/2015 Omae et al.

FOREIGN PATENT DOCUMENTS

JP 8-7967 A 1/1996
JP 11-97497 A 4/1999
JP 2001-167857 A 6/2001
JP 2004-119275 A 4/2004
JP 2006-155967 A 6/2006
JP 2013-254679 A 12/2013

OTHER PUBLICATIONS

The English translation of the Written Opinion of the International Search Report for PCT/JP2014/067818 dated Aug. 5, 2014.
Japanese Office Action for the related Japanese Patent Application No. 2013-140033 dated Jan. 31, 2017.

* cited by examiner

ABUTTING TYPE CONNECTOR

TECHNICAL FIELD

The present invention relates to a butting type connector.

BACKGROUND ART

FIG. 10 shows a butting type connector disclosed in below-described patent literature 1.

The butting type connector 100 includes a first butting terminal fitting 110 having a butting surface 111, a second butting terminal fitting 120 as a connection mate of the first butting terminal fitting 110, a first terminal accommodating member 130 made of a resin which holds the first butting terminal fitting 110 and a second terminal accommodating member 140 made of a resin which holds the second butting terminal fitting 120.

The first butting terminal fitting 110 is formed with metal. Further, the butting surface 111 of the first butting terminal fitting 110 is formed in a flat surface vertical to a butting direction (a direction shown by an arrow mark X1 in FIG. 10).

The second butting terminal fitting 120 is formed with a metal plate. The second butting terminal fitting 120 has a plurality of contact spring pieces 122 at an end of a tubular main body part 121. The contact spring pieces 122 are respectively formed in such a way that sheet pieces 123 extending in the butting direction from a peripheral wall of the main body part 121 are bent substantially in U-shaped configurations inside the main body part 121 to form curved surface shaped contact parts 122*a*.

In the plurality of contact spring pieces 122, positions of the contact parts 122*a* are respectively properly arranged on the same vertical surface so that the contact parts 122*a* of the contact spring pieces 122 may be butted against the butting surface 111 at the same time.

As shown in FIG. 11(*a*) to FIG. 11(*c*), when the contact parts 122*a* are butted against the butting surface 111, the plurality of contact spring pieces 122 are resiliently deformed so that the plurality of contact spring pieces 122 are electrically conducted and connected to the first butting terminal fitting 110.

As shown in FIG. 10, the first terminal accommodating member 130 holds the first butting terminal fitting 110 so that an end of the butting surface 111 of the first butting terminal fitting 110 is exposed.

The second terminal accommodating member 140 is made of a resin. The second terminal accommodating member 140 holds the second butting terminal fitting 120 so that the plurality of contact spring pieces 122 of the second butting terminal fitting 120 are butted against the butting surface 111 when the second terminal accommodating member 140 is butted against the first terminal accommodating member 130.

PRIOR ART LITERATURE

Patent Literature

[Patent Literature 1] JP-A-Hei8-7967

SUMMARY OF INVENTION

Technical Problems

In the case of the second butting terminal fitting 120 in the butting type connector 100 of the patent literature 1, the plurality of contact spring pieces 122 have three-dimensional structures in which the plurality of contact spring pieces 122 are bent in the U-shaped configurations, so that the structure is complicated. Accordingly, a problem arises that a production cost of the second butting terminal fitting 120 increases.

Further, in the case of the butting type connector 100 of the patent literature 1, the butting surface 111 of the first butting terminal fitting 110 is a simple flat surface. Accordingly, when, for instance, an inclination (a three-dimensional positional shift) occurs in the first butting terminal fitting 110 due to an assembly error or a tolerance, one side of the butting surface 111 (one side of the inclination) comes near to the second butting terminal fitting 120 and the other side (the other side of the inclination) of the butting surface 111 is separated from the second butting terminal fitting 120. Accordingly, there is a fear that the contact spring piece 122 located in a position opposed to the other side (the other side of the inclination) of the butting surface 111 may not possibly come into contact with the butting surface 111 or a contact pressure may possibly become a reference value or lower, so that a connection performance between connection terminals may be lowered.

Thus, it is an object of the present invention to solve the above-described problems and provide a butting type connector which can ensure a stable connection performance between butting terminal fittings even when an inclination arises between the butting terminal fittings which are mutually butted against owing to an influence of an assembly error or a tolerance and can simplify a structure of the butting terminal fitting to reduce a production cost.

Solution to Problem

The above-described object of the present invention is achieved by below-described structures.

(1) A butting type connector comprising, a first butting terminal fitting having a butting surface, a second butting terminal fitting made of a metal plate and having a plurality of contact spring pieces which are resiliently deformed when the plurality of the contact spring pieces are butted against the butting surface so as to be electrically conducted and connected to the first butting terminal fitting, a first terminal accommodating member which holds the first butting terminal fitting so that the butting surface is exposed, and a second terminal accommodating member which holds the second butting terminal fitting so that the plurality of the contact spring pieces are butted against the butting surface when the second terminal accommodating member is butted against the first terminal accommodating member, wherein the butting surface is formed in a curved-surface configuration protruding to the second butting terminal fitting side, wherein the plurality of the contact spring pieces are a plurality of flat plate type leaf spring pieces.

(2) The butting type connector according to the above mentioned (1), wherein the butting surface is an outer peripheral surface of a semi-cylindrical raised structure whose cross-sectional form is a circular arc surface, wherein the plurality of the contact spring pieces are flat plate type leaf springs which extend in the orthogonal direction to a generatrix of the butting surface, and wherein the plurality of the contact spring pieces are arranged in a configuration of comb teeth at regular intervals to a direction of the generatrix of the butting surface.

(3) The butting type connector according to the above-mentioned (2), wherein the plurality of the contact spring pieces comprises:

a first group of leaf spring pieces having the flat plate type leaf spring pieces which extend from a first edge part of the second butting terminal fitting opposed to one side of the butting surface and whose free end sides circumscribe the butting surface and which are arranged in the configurations of the comb teeth at regular intervals to the direction of the generatrix of the butting surface; and, a second group of leaf spring pieces having the flat plate type leaf spring pieces which extend from a second edge part of the second butting terminal fitting opposed to the other side of the butting surface and whose free end sides circumscribe the butting surface and which are arranged in the configurations of the comb teeth at regular intervals to the direction of the generatrix of the butting surface, wherein the leaf spring pieces of the first group of leaf spring pieces and the leaf spring pieces of the second group of leaf spring pieces are alternately arranged at regular intervals to the direction of the generatrix of the butting surface.

(4) The butting type connector according to the above-mentioned (3), wherein the lengths of the leaf spring pieces of the first group of the leaf spring pieces and the leaf spring pieces of the second group of the leaf spring pieces are set so that the tip end parts thereof are mutually overlapped.

(5) The butting type connector according to the above-mentioned (1), wherein the butting surface is an outer surface of a semi-spherical raised structure, wherein the plurality of the contact spring pieces are a plurality of flat plate type leaf spring pieces, and wherein the plurality of the flat plate type leaf spring pieces extend from a circumference part concentric with a center of the semi-spherical butting surface to a center of the circumference part and the plurality of the flat plate type leaf spring pieces are arranged in radial directions to the center of the circumference part.

According to the structure of the above-described (1), the plurality of contact spring pieces provided in the second butting terminal fitting are the plurality of flat plate type leaf spring pieces arranged on the same plane and have simple structures which do not need a bending work and can be simply formed only by blanking or stamping a metal sheet. Namely, according to the structure of the above-described (1), since the plurality of contact spring pieces are provided, the structure of the second butting terminal fitting can be avoided from being complicated. Since the structure is simplified, a production cost of the second butting terminal fitting can be reduced. As a result, the production cost of the butting type connector can be reduced.

Further, according to the structure of the above-described (1), since the butting surface of the first butting terminal fitting is formed in the curved-surface configuration protruding to the second butting terminal fitting side, even when an inclination arises between the butting terminal fittings which are mutually butted against owing to an influence of an assembling error or a tolerance, a variation of a clearance is hardly generated respectively between the contact spring pieces and the butting surface in comparison with the case that the butting surface is the flat surface.

In other words, even when the inclination arises between the butting terminal fittings which are mutually butted against due to the influence of the assembling error or the tolerance, a variation of a contact pressure between the contact spring pieces and the butting surface can be suppressed and a stable connection performance can be ensured between the butting terminal fittings.

According to the structure of the above-described (2), when the inclination which occurs in the first butting terminal fitting or the second butting terminal fitting due to the influence of the assembling error or the tolerance causes a turning movement of the terminal fitting in a plane which intersects at right angles to the generatrix of the butting surface, contact positions of the contact spring pieces and the butting surface respectively move on the butting surface in accordance with the inclination between both the terminal fittings.

However, since the clearance between the contact spring pieces and the butting surface is not varied, the variation of the contact pressure between the contact spring pieces and the butting surface can be prevented, so that a stable connection performance can be ensured between the butting terminal fittings.

According to the structure of the above-described (3) or (4), the plurality of leaf spring pieces of the first group of leaf spring pieces and the second group of leaf spring pieces provided in the second butting terminal fitting are arranged in the configurations of the comb teeth and in lines in such a way that the leaf spring pieces of the first group of leaf spring pieces and the leaf spring pieces of the second group of leaf spring pieces are arranged alternately. Accordingly, in the second butting terminal fitting, a larger number of contact spring pieces can be efficiently arranged.

Then, when the first group of leaf spring pieces and the second group of leaf spring pieces are provided so that a top part of the semi-cylindrical butting surface is located at a center of an overlapped area between the first group of leaf spring pieces and the second group of leaf spring pieces, the butting surface can be allowed to assuredly come into contact with the leaf spring pieces of the first group of leaf spring pieces respectively and the leaf spring pieces of the second group of leaf spring pieces respectively irrespective of a presence of an occurrence of the inclination between the butting terminal fittings.

Accordingly, irrespective of the presence of the occurrence of the inclination between the butting terminal fittings, a stable multi-contact connection can be realized.

According to the structure of the above-described (5), since the butting surface has a semi-spherical form and the plurality of contact spring pieces which are allowed to come into contact with the butting surface are arranged in the radial directions to the center of the butting surface, even when the inclination occurring in the first butting terminal fitting or the second butting terminal fitting due to the influence of the assembling error or the tolerance is an inclination of any direction, the butting surface and the plurality of contact spring pieces can maintain a stable contact state. Thus, a reliability of connection between the butting terminal fittings can be improved.

Advantageous Effects of Invention

In the butting type connector according to the present invention, even when the inclination arises between the butting terminal fittings which are mutually butted against due to the influence of the assembling error or the tolerance, the stable connection performance can be ensured between the butting terminal fittings, and further, the production cost can be reduced by simplifying the structure of the butting terminal fitting.

The present invention is briefly described above. Further, when modes for carrying out the invention (refer them to as "embodiments", hereinafter) which will be described below) are read by referring to the attached drawings, a detail of the present invention will be more clarified.

DESCRIPTION OF EMBODIMENTS

Figure 1:
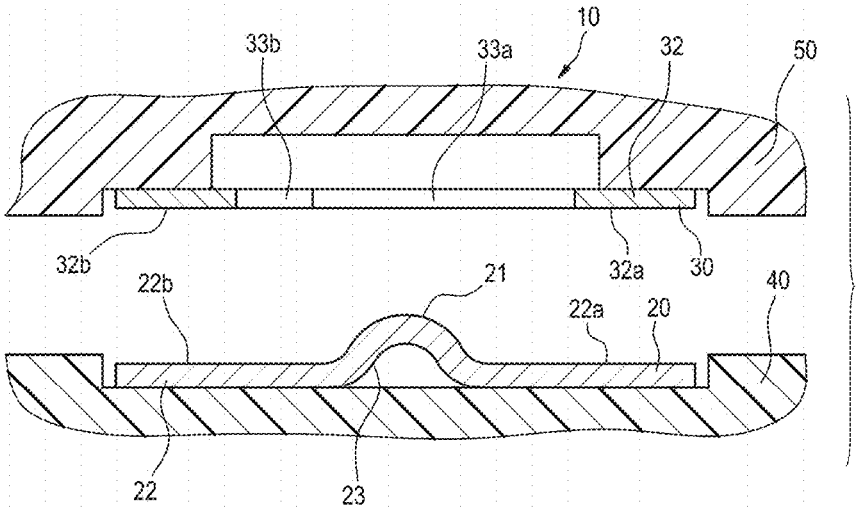
FIG. 1 is a schematically longitudinally sectional view of an opposed state of a first terminal accommodating member and a second terminal accommodating member of a butting type connector according to a first embodiment of the present invention.

Now, preferred embodiments of a butting type connector according to the present invention will be described below in more detail by referring to the drawings.

First Embodiment

Figure 2:
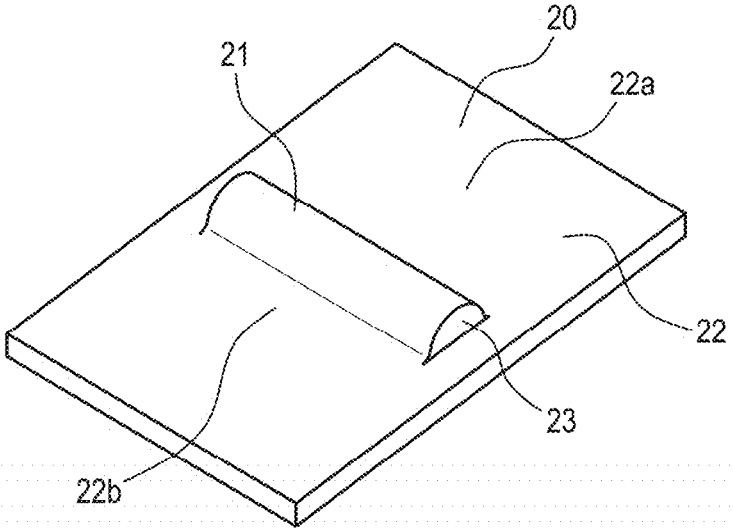
FIG. 2 is a perspective view of a first butting terminal fitting shown in FIG. 1.
Figure 3:
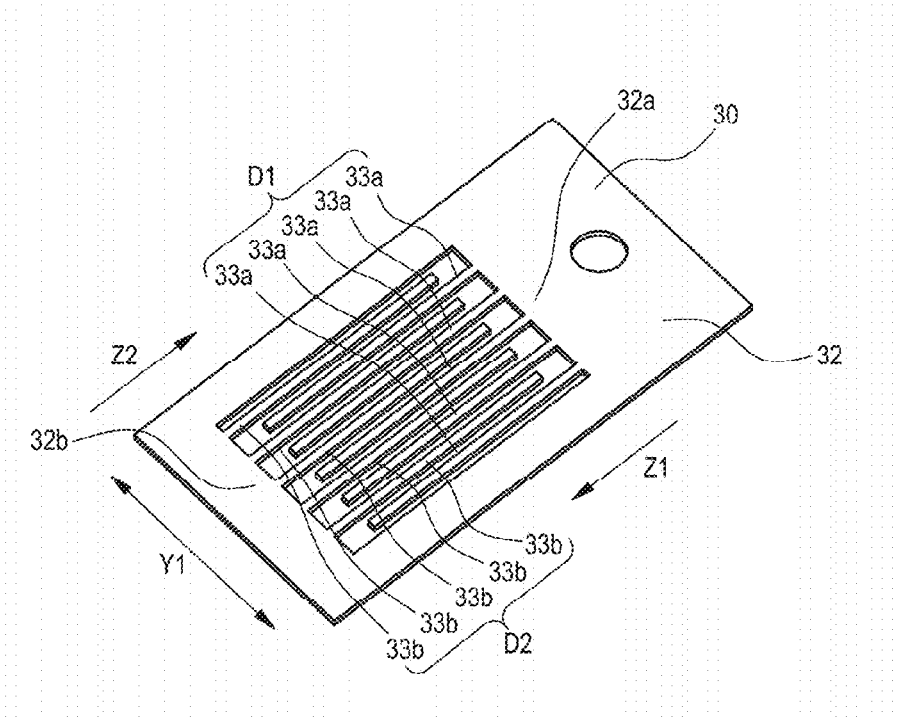
FIG. 3 is a perspective view of a second butting terminal fitting shown in FIG. 1.
Figure 4:
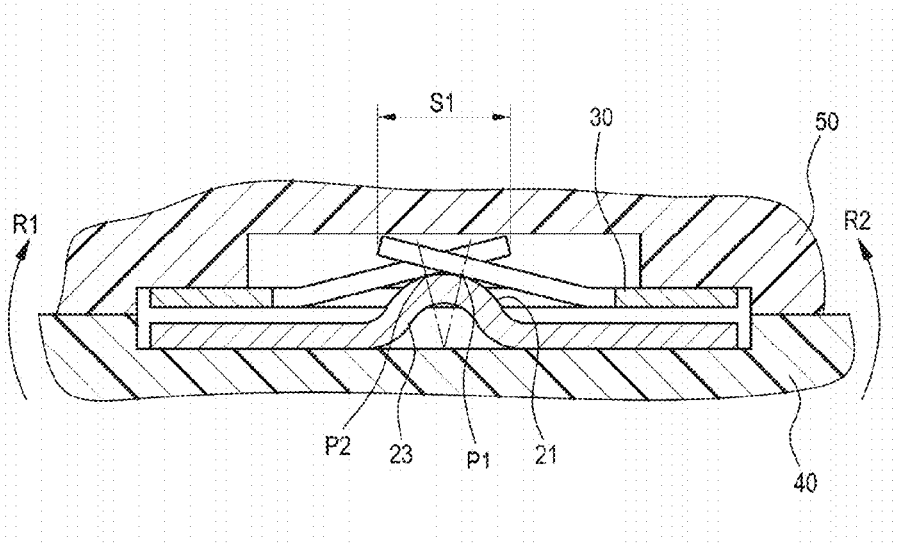
FIG. 4 is a schematically longitudinally sectional view of a state that a connection of the first terminal accommodating member and the second terminal accommodating member of the butting type connector of the first embodiment of the present invention is completed.

FIG. 1 to FIG. 4 show a butting type connector according to a first embodiment of the present invention. FIG. 1 is a schematically longitudinally sectional view of an opposed state of a first terminal accommodating member and a second terminal accommodating member of a butting type connector according to a first embodiment of the present invention. FIG. 2 is a perspective view of a first butting terminal fitting shown in FIG. 1. FIG. 3 is a perspective view of a second butting terminal fitting shown in FIG. 1. FIG. 4 is a schematically longitudinally sectional view of a state that a connection of the first terminal accommodating member and the second terminal accommodating member of the butting type connector of the first embodiment of the present invention is completed.

As shown in FIG. 1, the butting type connector 10 of the first embodiment includes a first butting terminal fitting 20 having a butting surface 21, a second butting terminal fitting 30 as a connection mate of the first butting terminal fitting 20, a first terminal accommodating member 40 made of a resin which holds the first butting terminal fitting 20 and a second terminal accommodating member 50 made of a resin which holds the second butting terminal fitting 30.

The first butting terminal fitting 20 is formed with a metal plate. Further, the butting surface 21 of the first butting terminal fitting 20 is formed in a curved-surface configuration protruding toward the second butting terminal fitting 30 side. In the case of the present embodiment, the butting surface 21 is an outer peripheral surface of a semi-cylindrical raised structure 23 which is formed to protrude in a central part of a rectangular flat plate shaped terminal main body 22. Accordingly, a cross-sectional form of the butting surface 21 is a circular arc surface protruding toward the second butting terminal fitting 30 side as shown in FIG. 1.

The second butting terminal fitting 30 is formed with a metal plate. The second butting terminal fitting 30 has a first group of leaf spring pieces D1 and a second group of leaf spring pieces D2 in a central part of a rectangular flat plate shaped terminal main body 32.

The first group of leaf spring pieces D1 is formed in such a way that a plurality of flat plate type leaf spring pieces 33*a* are arranged in configurations of comb teeth at regular intervals to a direction (a direction of an arrow mark Y1 in FIG. 3) of a generatrix of the butting surface 21. The leaf spring pieces 33*a* respectively forming the first group of lead spring pieces D1 are extended along a first direction (a direction of an arrow mark Z1 in FIG. 3) which intersects at right angles to the direction of the generatrix of the butting surface 21 from a first edge part 32*a* on the terminal main body 32. Further, in the leaf spring pieces 33*a* respectively, lengths thereof are set so that free end sides of the leaf spring pieces circumscribe the butting surface 21.

As shown in FIG. 1, the first edge part 32*a* on the terminal main body 32 is a part opposed to a first outer edge part 22*a* located in one side of the butting surface 21. The first outer edge part 22*a* is an area on the terminal main body 22 located in the one side of the butting surface 21.

The leaf spring pieces 33*a* respectively forming the first group of leaf spring pieces D1 are formed by a blanking or stamping operation.

The second group of leaf spring pieces D2 is formed in such a way that a plurality of flat plate type leaf spring pieces 33*b* are arranged in configurations of comb teeth at regular intervals to the direction (the direction of the arrow mark Y1 in FIG. 3) of the generatrix of the butting surface 21 as the outer peripheral surface of the semi-cylindrical raised structure 23. The leaf spring pieces 33*b* respectively forming the second group of lead spring pieces D2 are extended along a second direction (a direction of an arrow mark Z2 in FIG. 3) which intersects at right angles to the direction of the generatrix of the butting surface 21 from a second edge part 32*b* on the terminal main body 32. Further, in the leaf spring pieces 33*b* respectively, lengths thereof are set so that free end sides of the leaf spring pieces circumscribe the butting surface 21.

As shown in FIG. 1, the second edge part 32*b* on the terminal main body 32 is a part opposed to a second outer edge part 22*b* located in the other side of the butting surface 21. The second outer edge part 22*b* is an area on the terminal main body 22 located in the other side of the butting surface 21.

The leaf spring pieces 33*b* respectively forming the second group of leaf spring pieces D2 are formed by a blanking or stamping operation.

The plurality of leaf spring pieces 33*a* which form the first group of leaf spring pieces D1 and the plurality of leaf spring pieces 33*b* which form the second group of leaf springs D2 are arranged on the same plane. Further, the plurality of leaf spring pieces 33*a* and the plurality of leaf spring pieces 33*b* are formed in such a way that the leaf spring pieces 33*a* and the leaf spring pieces 33*b* are alternately arranged at regular intervals to the direction of the generatrix of the butting surface 21. Further, in the case of the present embodiment, lengths of the leaf spring pieces 33*a* and the leaf spring pieces 33*b* are set so that tip end parts of the leaf spring pieces 33*a* and the leaf spring pieces 33*b* are mutually overlapped.

The leaf spring pieces 33*a* and the leaf spring pieces 33*b* are contact spring pieces which are resiliently deformed when they are butted against the butting surface 21 to be electrically conducted and connected to the first butting terminal fitting 20. In the present embodiment, as shown in FIG. 4, dimensions of the butting terminal fittings 20 and 30 are respectively set so that the butting surface 21 may abut on the leaf spring pieces 33*a* and 33*b* respectively substantially at a center of an overlapped area S1 of the leaf spring pieces 33*a* and the leaf spring pieces 33*b*.

The first terminal accommodating member 40 is housing made of the resin which holds the first butting terminal fitting 20. The first terminal accommodating member 40 holds, as shown in FIG. 1, the first butting terminal fitting 20 so that the butting surface 21 of the first butting terminal fitting 20 is exposed to an end.

The second terminal accommodating member 50 is housing made of the resin which holds the second butting terminal fitting 30. As shown in FIG. 4, the second terminal accommodating member 50 holds the second butting terminal fitting 30 in such a way that when the second terminal accommodating member 50 is butted against the first terminal accommodating member 40, the plurality of contact spring pieces 33*a* and 33*b* of the second butting terminal fitting 30 held thereby are butted against the butting surface 21 so that a resilient deformation occurs in the leaf spring pieces 33*a* and the leaf spring pieces 33*b*.

In the case of the above-described butting type connector 10 of the first embodiment, the plurality of leaf spring pieces (the contact spring pieces) 33*a* and 33*b* provided in the second butting terminal fitting 30 are the plurality of flat plate type leaf spring pieces arranged on the same plane and have simple structures which do not need a bending work and can be simply formed only by blanking or stamping a metal sheet.

Namely, in the butting type connector 10 of the first embodiment, since the plurality of leaf spring pieces 33*a* and 33*b* are provided, the structure of the second butting terminal fitting 30 can be avoided from being complicated. Since the structure is simplified, a production cost of the second butting terminal fitting 30 can be reduced. As a result, the production cost of the butting type connector 10 can be reduced.

Further, in the butting type connector 10 of the first embodiment, since the butting surface 21 of the first butting terminal fitting 20 is formed in the curved-surface configuration protruding to the second butting terminal fitting 30 side, even when an inclination arises between the butting terminal fittings 20 and 30 which are mutually butted against owing to an influence of an assembling error or a tolerance, a variation of a clearance is hardly generated respectively between the leaf spring pieces 33*a* and 33*b* and the butting surface 21 in comparison with the case that the butting surface 21 is the flat surface.

In other words, even when the inclination arises between the butting terminal fittings 20 and 30 which are mutually butted against due to the influence of the assembling error or the tolerance, a variation of a contact pressure between the leaf spring pieces 33*a* and 33*b* and the butting surface 21 can be suppressed and a stable connection performance can be ensured between the butting terminal fittings 20 and 30.

Further, in the butting type connector 10 of the first embodiment, when the inclination which occurs in the first butting terminal fitting 20 or the second butting terminal fitting 30 due to the influence of the assembling error or the tolerance causes a turning movement of the terminal fitting in a direction shown by an arrow mark R1 or R2 in FIG. 4 in a plane (a sheet surface in FIG. 4) which intersects at right angles to the generatrix of the butting surface 21, contact positions P1 and P2 of the leaf spring pieces 33*a* and 33*b* and the butting surface 21 respectively move on the butting surface 21 in accordance with the inclination between both the terminal fittings.

However, since the clearance between the leaf spring pieces 33*a* and 33*b* and the butting surface 21 is not varied, the variation of the contact pressure between the leaf spring pieces 33*a* and 33*b* and the butting surface 21 can be prevented, so that a stable connection performance can be ensured between the butting terminal fittings 20 and 30.

Further, in the butting type connector 10 of the first embodiment, the plurality of leaf spring pieces 33*a* and 33*b* of the first group of leaf spring pieces D1 and the second group of leaf spring pieces D2 provided in the second butting terminal fitting 30 are arranged in the configurations of the comb teeth and in lines in such a way that the leaf spring pieces 33*a* of the first group of leaf spring pieces D1 and the leaf spring pieces 33*b* of the second group of leaf spring pieces D2 are arranged alternately. Accordingly, in the second butting terminal fitting 30, a larger number of leaf spring pieces 33*a* and 33*b* can be efficiently arranged.

Then, when the first group of leaf spring pieces D1 and the second group of leaf spring pieces D2 are provided so that a top part of the semi-cylindrical butting surface 21 is located substantially at a center of an overlapped area S1 between the first group of leaf spring pieces D1 and the second group of leaf spring pieces D2, the butting surface 21 can be allowed to assuredly come into contact with the leaf spring pieces 33*a* of the first group of leaf spring pieces D1 respectively and the leaf spring pieces 33*b* of the second group of leaf spring pieces D2 respectively irrespective of a presence of an occurrence of the inclination between the butting terminal fittings 20 and 30.

Accordingly, irrespective of the presence of the occurrence of the inclination between the butting terminal fittings 20 and 30, a stable multi-contact connection can be realized.

Second Embodiment

Figure 5:
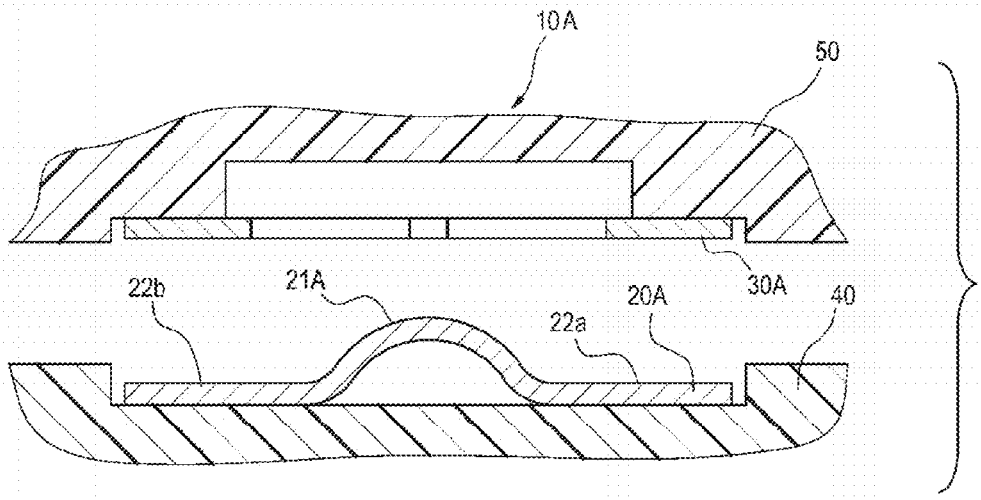
FIG. 5 is a schematically longitudinally sectional view of an opposed state of a first terminal accommodating member and a second terminal accommodating member of a butting type connector according to a second embodiment of the present invention.
Figure 6:
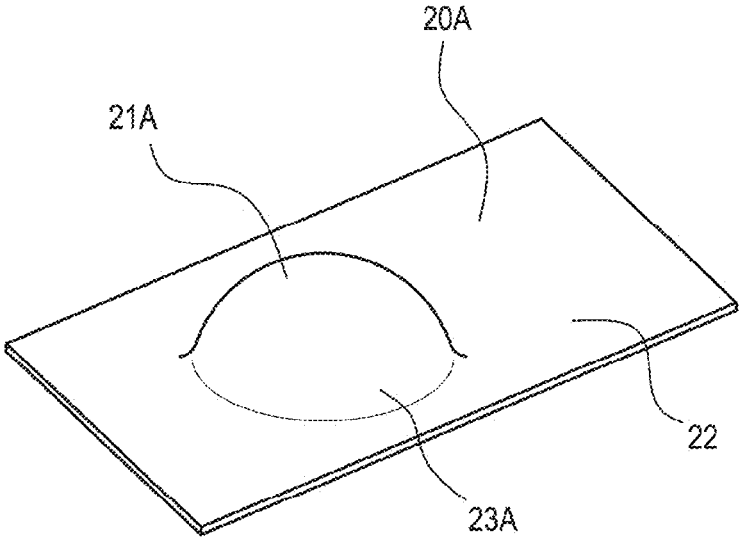
FIG. 6 is a perspective view of a first butting terminal fitting shown in FIG. 5.
Figure 7:
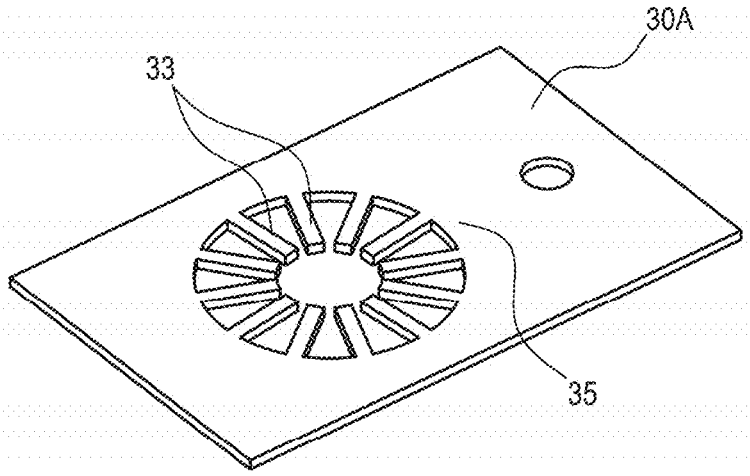
FIG. 7 is a perspective view of a second butting terminal fitting shown in FIG. 5.
Figure 8:
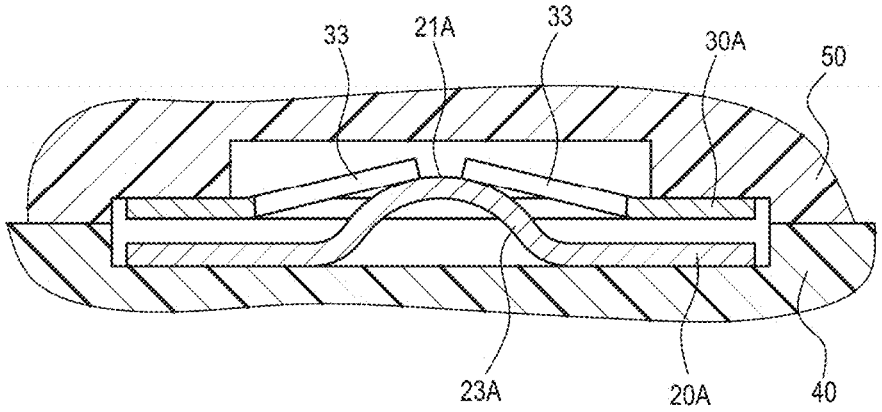
FIG. 8 is a schematically longitudinally sectional view of a state that a connection of the first terminal accommodating member and the second terminal accommodating member of the butting type connector of the second embodiment of the present invention is completed.

FIG. 5 to FIG. 8 show a butting type connector according to a second embodiment of the present invention. FIG. 5 is a schematically longitudinally sectional view of an opposed state of a first terminal accommodating member and a second terminal accommodating member of a second embodiment of the present invention. FIG. 6 is a perspective view of a first butting terminal fitting shown in FIG. 5. FIG. 7 is a perspective view of a second butting terminal fitting shown in FIG. 5. FIG. 8 is a schematically longitudinally sectional view of a state that a connection of the first terminal accommodating member and the second terminal accommodating member of the butting type connector of the second embodiment of the present invention is completed.

As shown in FIG. 5, the butting type connector 10A of the second embodiment includes a first butting terminal fitting 20A having a butting surface 21A, a second butting terminal fitting 30A as a connection mate of the first butting terminal fitting 20A, a first terminal accommodating member 40 made of a resin which holds the first butting terminal fitting 20A and a second terminal accommodating member 50 made of a resin which holds the second butting terminal fitting 30A.

The first terminal accommodating member 40 and the second terminal accommodating member 50 in the butting type connector 10A of the second embodiment are the same articles as the first terminal accommodating member 40 and the second terminal accommodating member 50 in the first embodiment.

The first butting terminal fitting 20A in the second embodiment is formed with a metal plate. The butting surface 21A of the first butting terminal fitting 20A is an outer surface of a semi-spherical raised structure 23A. In the first butting terminal fitting 20A, other structures than the butting surface 21A are common to those of the first butting terminal fitting in the first embodiment. The common structures are designated by the same reference numerals as those of the first embodiment and an explanation thereof will be omitted.

The second butting terminal fitting 30A in the second embodiment is formed with a metal plate. The second butting terminal fitting 30A has a plurality of contact spring pieces 33 in a central part of a rectangular flat plate shaped terminal main body 32. The contact spring pieces 33 are respectively flat plate type leaf spring pieces. Further, the plurality of contact spring pieces 33 are arranged on the same plane.

In the present embodiment, the plurality of contact spring pieces 33 are extended from a circumference part 35 concentric with a center of the semi-spherical butting surface 21A to a center of the circumference part 35, and arranged in radial directions to the center of the circumference part 35.

In the butting type connector 10A of the second embodiment, as shown in FIG. 8, when the second terminal accommodating member 50 is butted against the first terminal accommodating member 40, the semi-spherical butting surface 21A of the first butting terminal fitting 20A is butted against the plurality of contact spring pieces 33 of the second butting terminal fitting 30A to resiliently deform the contact spring pieces 33. Thus, the first butting terminal fitting 20A is electrically conducted and connected to the second butting terminal fitting 30A.

In the butting type connector 10A of the second embodiment, since the butting surface 21A of the first butting terminal fitting 20A has a semi-spherical form and the plurality of contact spring pieces 33 which are allowed to come into contact with the butting surface 21A are arranged in the radial directions to the center of the butting surface 21A, even when an inclination occurring in the first butting terminal fitting 20A or the second butting terminal fitting 30A due to an influence of an assembling error or a tolerance is an inclination in any direction, the butting surface 21A and the plurality of contact spring pieces 33 can maintain a stable contact state. Thus, a reliability of connection between the butting terminal fittings 20A and 30A can be improved.

The present invention is not limited to the above-described embodiments and may be suitably modified and improved. In addition thereto, as long as the present invention can be achieved, materials, configurations, dimensions, number and arranged positions of component elements in the above-described embodiments are arbitrary and are not limited.

Figure 9:
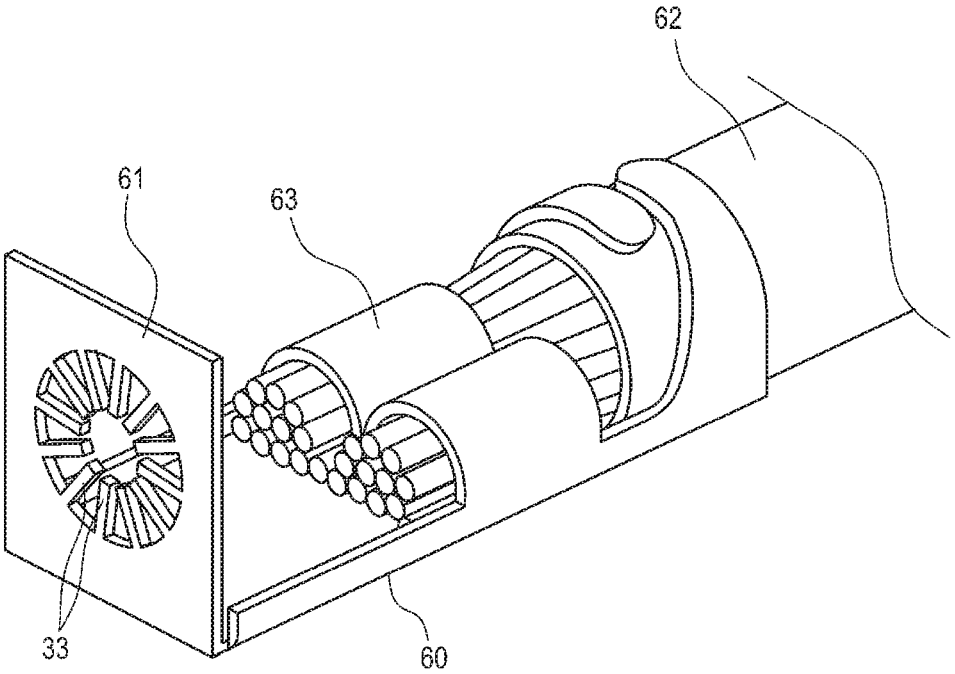
FIG. 9 is a perspective view of a modified example of a second butting terminal fitting according to the present invention.
Figure 10:
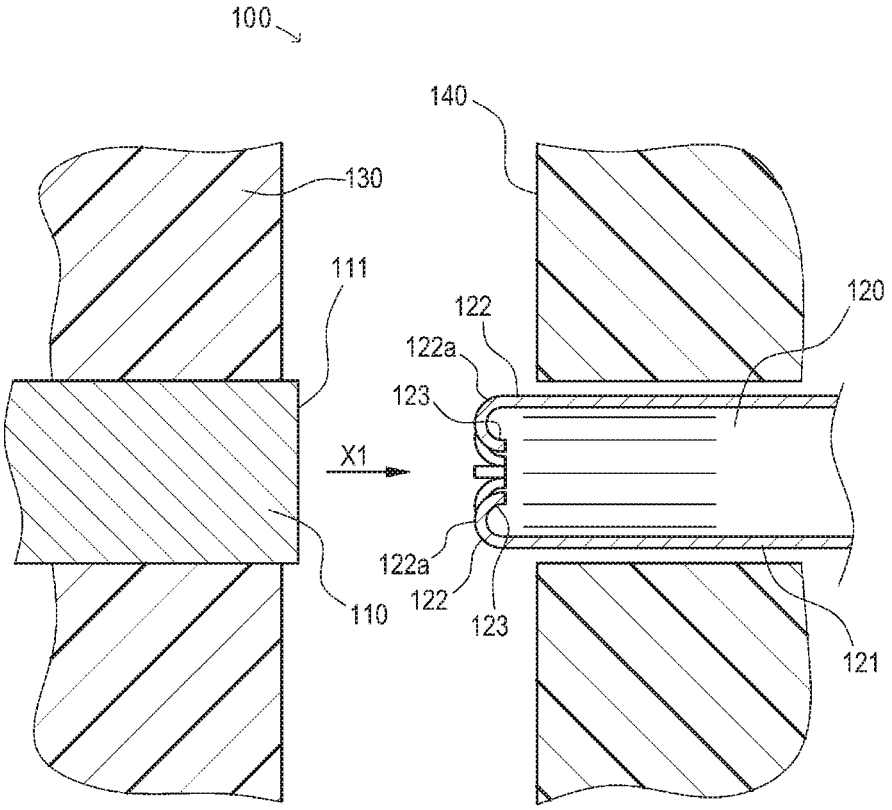
FIG.10 Prior Art
FIG. 10 is a longitudinally sectional view of a usual butting type connector.
Figure 11:
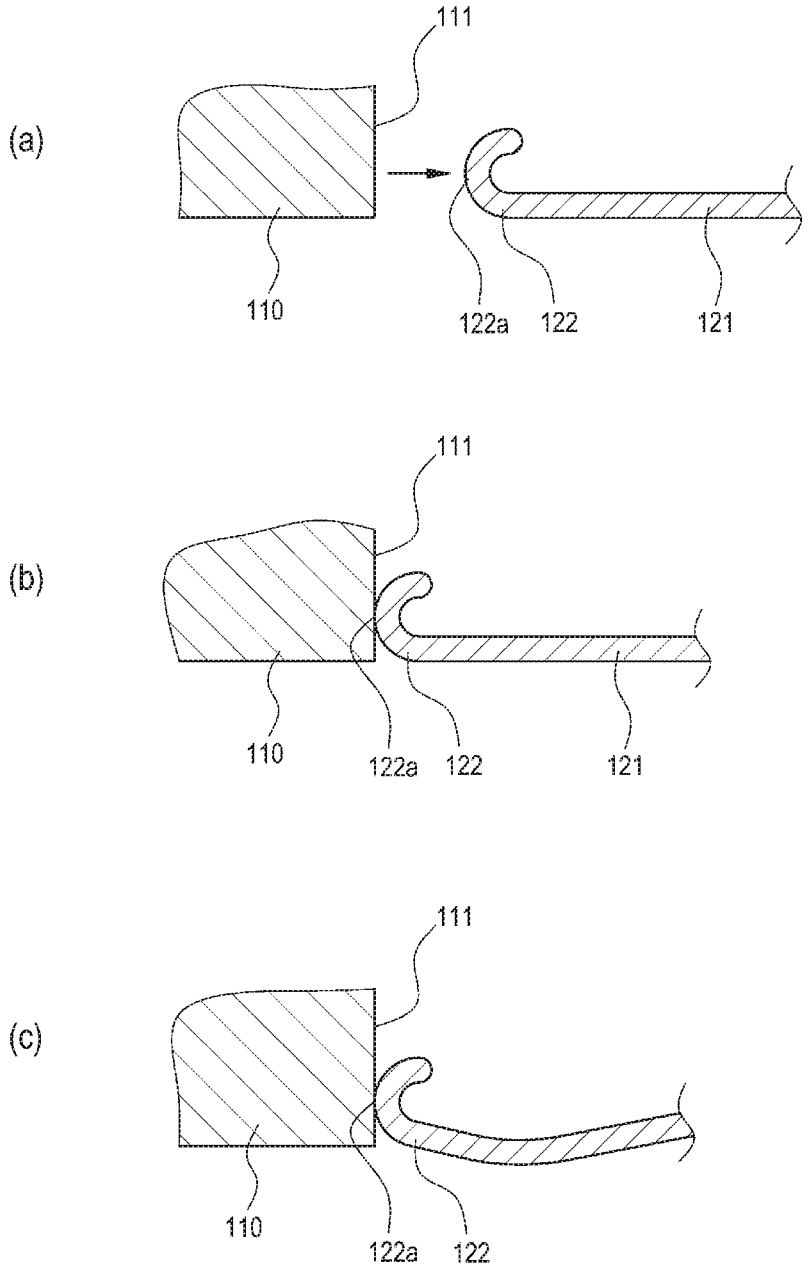
FIG. 11 Prior Art
FIG. 11(*a*) to FIG. 11(*c*) are explanatory views of processes that a butting surface of a first butting terminal fitting is butted against a contact spring piece of a second butting terminal fitting in the butting type connector shown in FIG. 10.

For instance, the first butting terminal fitting or the second butting terminal is not limited to the simple flat plate shaped structure shown in the above-described embodiments. As shown in FIG. 9, a butting terminal fitting 60 having a three-dimensional structure may be used.

In the butting terminal fitting 60 shown in FIG. 9, an electric wire connecting part 63 which attaches and connects an electric wire 62 under pressure is formed integrally with one side edge of a butting part 61 of a flat plate shaped structure. The butting part 61 of the flat plate shaped structure as an illustrated example has the same structure as that of the second butting terminal fitting 30A of the second embodiment and has a plurality of contact spring pieces 33 provided in radial directions in a central part.

Further, a specific form of the butting surface is not limited to the forms respectively shown in the above-described embodiments. For instance, the butting surface may be configured in a conical form.

Now, features of the above-described embodiments of the butting type connector according to the present invention will be briefly described together in below-described [1] to [5].

[1] A butting type connector (10) comprising:

a first butting terminal fitting (20) having a butting surface (21);

a second butting terminal fitting (30) made of a metal plate and having a plurality of contact spring pieces (33*a*, 33*b*) which are resiliently deformed when they are butted against the butting surface (21) so as to be electrically conducted and connected to the first butting terminal fitting (20);

a first terminal accommodating member (40) which holds the first butting terminal fitting (20) so that the butting surface (21) is exposed; and a second terminal accommodating member (50) which holds the second butting terminal fitting (30) so that the plurality of contact spring pieces (33*a*, 33*b*) are butted against the butting surface (21) when the second terminal accommodating member is butted against the first terminal accommodating member (40), wherein the butting surface (21) is formed in a curved-surface configuration protruding to the second butting terminal fitting (30) side, wherein the plurality of contact spring pieces (33*a*, 33*b*) are a plurality of flat plate type leaf spring pieces.

[2] The butting type connector (10) described in the above-mentioned [1], wherein the butting surface (21) is an outer peripheral surface of a semi-cylindrical raised structure (23) whose cross-sectional form is a circular arc surface, wherein the contact spring pieces (33*a*, 33*b*) are flat plate type leaf springs which extend in the orthogonal direction to a generatrix of the butting surface (21), and wherein the plurality of contact spring pieces (33*a*, 33*b*) are arranged in a configuration of comb teeth at regular intervals to the direction of the generatrix of the butting surface (21).

[3] The butting type connector (10) described in the above-mentioned [2], wherein the plurality of contact spring pieces (33*a*, 33*b*) comprises:

a first group of leaf spring pieces (D1) having the flat plate type leaf spring pieces (33*a*) which extend from a first edge part (32*a*) of the second butting terminal fitting opposed to one side of the butting surface (21) and whose free end sides circumscribe the butting surface (21) and which are arranged in the configurations of the comb teeth at regular intervals to the direction of the generatrix of the butting surface (21); and, a second group of leaf spring pieces (D2) having the flat plate type leaf spring pieces (33*b*) which extend from a second edge part (32*b*) of the second butting terminal fitting opposed to the other side of the butting surface (21) and whose free end sides circumscribe the butting surface (21) and which are arranged in the configurations of the comb teeth at regular intervals to the direction of the generatrix of the butting surface (21), wherein the leaf spring pieces (33*a*) of the first group of leaf spring pieces (D1) and the leaf spring pieces (33*b*) of the second group of leaf spring pieces (D2) are alternately arranged at regular intervals to the direction of the generatrix of the butting surface (21), and wherein lengths of the leaf spring pieces are set so that tip end parts thereof are mutually overlapped.

[4] The butting type connector (10) described in the above-mentioned [3], wherein the lengths of the leaf spring pieces (33*a*) of the first group of leaf spring pieces (D1) and the leaf spring pieces (33*b*) of the second group of leaf spring pieces (D2) are set so that the tip end parts thereof are mutually overlapped.

[5] The butting type connector (10A) described in the above-mentioned [1], wherein the butting surface (21A) is an outer surface of a semi-spherical raised structure (23A), wherein the plurality of contact spring pieces (33) are a plurality of flat plate type leaf spring pieces, and wherein the plurality of the flat plate type leaf spring pieces extend from a circumference part (35) concentric with a center of the semi-spherical butting surface (21A) to a center of the circumference part (35) and the plurality of the flat plate type leaf spring pieces are arranged in radial directions to the center of the circumference part (35).

The present invention is described in detail by referring to the specific embodiments. However, it is to be understood to a person with ordinary skill in the art that various changes or modifications may be added to the invention without departing from the spirit and scope of the present invention.

This application is based on Japanese Patent Application (No. 2013-140033) filed on Jul. 3, 2013 and contents thereof are incorporated herein as a reference.

INDUSTRIAL APPLICABILITY

According to the present invention, even when the inclination arises between the butting terminal fittings which are butted against due to the influence of the assembling error or the tolerance, the stable connection performance can be ensured between the butting terminal fittings. Further, the structure of the butting terminal fitting is simplified, so that the production cost can be effectively reduced. The present invention having the above-described effects is available to the butting type connector.

REFERENCE SIGNS LIST

10, 10A butting type connector
20 first butting terminal fitting
21 butting surface
22*a* first outer edge part
22*b* second outer edge part
23 semi-cylindrical raised structure
23A semi-spherical raised structure
30 second butting terminal fitting
32*a* first edge part
32*b* second edge part
33 contact spring piece
33*a*, 33*b* leaf spring piece (contact spring piece)
40 first terminal accommodating member
50 second terminal accommodating member
D1 first group of leaf spring pieces
D2 second group of leaf spring pieces

What is claimed is:

1. A butting connector comprising:

a first butting terminal fitting metal sheet having a terminal butting surface;

a second butting terminal fitting made of a metal plate and having a plurality of contact spring pieces which are resiliently deformed when the plurality of the contact spring pieces are butted against the terminal butting surface so as to be electrically conducted and connected to the first butting terminal fitting metal sheet;

a first terminal accommodating member which holds the first butting terminal fitting metal sheet so that the terminal butting surface is exposed; and a second terminal accommodating member which holds the second butting terminal fitting so that the plurality of the contact spring pieces are butted against the terminal butting surface when the second terminal accommodating member is butted against the first terminal accommodating member, wherein the terminal butting surface is formed in a curved-surface configuration protruding to a second butting terminal fitting side, wherein the plurality of the contact spring pieces are a plurality of flat plate leaf spring pieces, wherein the terminal butting surface is an outer peripheral surface of a semi-cylindrical raised structure whose cross-sectional form is a circular arc surface, wherein the plurality of the contact spring pieces are flat plate leaf springs which extend in an orthogonal direction to an extending direction in which the terminal butting surface extends along the first butting terminal fitting metal sheet, wherein the plurality of the contact spring pieces are arranged in a configuration of comb teeth at regular intervals to the extending direction of the terminal butting surface, and wherein each of the plurality of the contact spring pieces has a linear shape and are parallel to each other.

2. The butting connector according to claim 1, wherein the plurality of the contact spring pieces comprise:

a first group of leaf spring pieces having the flat plate leaf spring pieces which extend from a first edge part of the second butting terminal fitting opposed to one side of the terminal butting surface and whose free end sides circumscribe the terminal butting surface and which are arranged in the configurations of the comb teeth at regular intervals to the extending direction of the terminal butting surface; and, a second group of leaf spring pieces having the flat plate leaf spring pieces which extend from a second edge part of the second butting terminal fitting opposed to the other side of the terminal butting surface and whose free end sides circumscribe the terminal butting surface and which are arranged in the configurations of the comb teeth at regular intervals to the extending direction of the terminal butting surface, wherein the leaf spring pieces of the first group of leaf spring pieces and the leaf spring pieces of the second group of leaf spring pieces are alternately arranged at regular intervals to the extending direction of the terminal butting surface.

3. The butting connector according to claim 2, wherein the lengths of the leaf spring pieces of the first group of the leaf spring pieces and the leaf spring pieces of the second group of the leaf spring pieces are set so that the tip end parts thereof are mutually overlapped.

4. The butting connector according to claim 1, wherein the first butting terminal fitting metal sheet has a substantially constant cross-sectional sheet thickness.

5. The butting connector according to claim 1, wherein the first butting terminal fitting metal sheet includes a first surface, and a second surface opposite to the first surface, the first surface includes a convex portion relative to an adjacent portion of the first surface, and the convex portion includes the terminal butting surface, and the second surface includes a concave portion relative to an adjacent portion of the second surface, and concave portion directly opposes the convex portion.

6. The butting connector according to claim 1, wherein the first butting terminal fitting metal sheet includes a first surface, and a second surface opposite to the first surface, the first surface includes the terminal butting surface, the first butting terminal fitting metal sheet has a first thickness measured from the first surface to the second surface at a location spaced away from the terminal butting surface, and the first butting terminal fitting metal sheet has a second thickness measured from the first surface to the second surface at a location that includes the terminal butting surface, and the first thickness is substantially the same as the second thickness.

7. The butting connector according to claim 1, wherein the first terminal accommodating member includes a first butting surface, and a first recessed surface which is recessed away from the first butting surface, the first butting terminal fitting metal sheet is mounted in the first recessed surface, the first butting surface butts the second terminal accommodating member, and the terminal butting surface protrudes beyond the first butting surface.

8. The butting connector according to claim 7, wherein the second terminal accommodating member includes a second butting surface, a second recessed surface which is recessed away from the second butting surface and receives the second butting terminal fitting, and a third recessed surface which is recessed way from each of the second butting surface and the second recessed surface, and at least a portion of the terminal butting surface extends into a recess formed by the third recessed surface when the second butting surface is butted against the first butting surface.

9. The butting connector according to claim 1, wherein the second butting terminal fitting further includes an electric wire connecting part connected to and spaced away from the plurality of contact spring pieces, and the electric wire connecting part configured to receive and crimp an electric wire thereto.

* * * * *